US005253666A

United States Patent [19]

Huang

[11] Patent Number: 5,253,666

[45] Date of Patent: Oct. 19, 1993

[54] UMBRELLA OPENING AND CLOSING DEVICE WITHOUT USE OF SPRING LATCHES

[75] Inventor: Shih-Chen Huang, Chang-hua, Taiwan

[73] Assignee: Yung Shun Umbrella Co., Ltd., Changhua, Taiwan

[21] Appl. No.: 942,847

[22] Filed: Sep. 10, 1992

[51] Int. Cl.[5] ..... A45B 25/06

[52] U.S. Cl. ..... 135/28; 135/39; 135/41

[58] Field of Search ..... 135/28, 37, 38, 39, 135/41; 403/339, 340

[56] References Cited

U.S. PATENT DOCUMENTS

| | | | |
|---|---|---|---|
| 2,528,002 | 10/1950 | Katzberg | 135/39 |
| 2,567,284 | 9/1951 | Hacken et al. | 135/41 X |
| 4,328,839 | 5/1982 | Lyons et al. | 403/339 X |

FOREIGN PATENT DOCUMENTS

| | | | |
|---|---|---|---|
| 362590 | 4/1906 | France | 135/38 |
| 12816 | of 1897 | United Kingdom | 135/38 |

*Primary Examiner*—Carl D. Friedman
*Assistant Examiner*—Lan M. Mai
*Attorney, Agent, or Firm*—Bacon & Thomas

[57] ABSTRACT

An umbrella opening and closing device adapted for a non-foldable umbrella and is particularly characterized in its simple structure and the lack of conventional spring lactches used to support the main runner in place when the canopy of the umbrella is opened. The present opening and closing device is made up of a first retainer extended from a fixed upper mounting member and a second retainer secured to the slidable main runner that are able to be tightly engaged with each other when the umbrella is opened and can be forced to separate when the umbrella is to be collapsed. A rib fixing ring having a plurality of securing recesses disposed on the periphery thereof is located just below the second retainer for the catching of the ribs of the closed umbrella. The first retainer is provided with a number of female cavities and the second retainer is provided with a number of male protrusions; each male protrusion and each female cavity is made integrally complementary in shape to each other so that each protrusion can be tightly fitted in the corresponding cavity when the first retainer and the second retainer is engaged with each other so as to firmly keep the main runner in place for opening the umbrella.

1 Claim, 3 Drawing Sheets

UMBRELLA OPENING AND CLOSING DEVICE WITHOUT USE OF SPRING LATCHES

BACKGROUND OF THE INVENTION

The present invention relates to an umbrella opening and closing device without use of a spring latch which is particularly adapted for a non foldable and hand operated umbrella. The present device is comprised of a first retainer extended from an upper mounting member and a second retainer integrally associated with a main runner of the umbrella; the first retainer is provided with a number of female cavities and the second retainer is provided with correspondingly a number of male protrusions. Each female cavity on the first retainer is integrally complementary in shape to a male protrusion on the second retainer whereby the male protrusions can be tightly fitted in the corresponding female cavities when the first retainer and the second retainer are engaged with each other in the opening of the umbrella.

In a conventional hand operated umbrella, an upper spring latch disposed on the upper portion of an intermediate post is used to support a main runner in place which is slidable on the main post of the umbrella and is connected to a plurality of stretching ribs that are in pivotal connection to a main frame of the umbrella at one end. A lower spring latch disposed at the bottom of the main post is used to lock the main runner in place so as to keep the closed umbrella well received without randomly being opened. The main frame is pivotally secured to an upper mounting member and a crown is disposed at the top of the umbrella and a handle is located at the bottom thereof for easy holding of the same. The spring lactch is resiliently operated so that the main runner can move thereover by forcing it into a slot in the opening of the umbrella and be supported in place by the spring latch popped out from the slot after the main runner has moved over it. To make the umbrella collapse, a person only has to push the spring latch into the slot and force the main runner to slide over it and pull the main runner down to the bottom of the post so as to effect the closing of the umbrella.

Although the prior art hand operated umbrella is not as easy and convenient as an automatically operated umbrella in use, anyway, it can be easily opened and closed by way of a main runner and is also simple in structure and has good durability in practical use; there are still some disadvantages associated therewith given as below:

1. The hand operated umbrella is simple in structure but it must be equipped with an upper and lower spring latch to hold the umbrella opened and well closed respectively, and the mounting of the spring latches onto the post of an umbrella is relatively complicated and time consuming.

2. To open or close the conventional umbrella, a person has to press the lower spring latch and the upper spring latch respectively into the corresponding slots so as to permit the main runner to move up or down thereover to expand the canopy attached to the main frame of the umbrella by way of the stretching ribs connected to the main runner or to make the canopy collapse in a reverse manner. The pressing against a spring latch will cause a little pain to the finger and is relatively inconvenient.

To overcome the above cited disadvantages of the prior art umbrella, a spring latchless umbrella is developed, as shown in FIG. 1. This type of umbrella adopts a main runner 13 to which are pivotally connected a plurality of stretching ribs 14 at the upper portion thereof and a plurality of resilient spring elements 15 at the lower portion thereof. The other ends of the stretching ribs 14 and the spring elements 15 are pivotally coupled to the main frame 12 at adjacent points thereon. The main runner 13 is slidably disposed on a central post 10, a shock absorbing element 16 is disposed near the top of the central post under an upper mounting member 11. A buffer element 17 is mounted onto the top of the main runner 13. The construction of this type of umbrella enables the same to be operated without the use of spring latches, but there are still some disadvantages associated therewith:

1. The use of a plurality of spring elements to replace the conventional spring latches makes the assembly complicated and time consuming.

2. The spring elements used to keep the canopy of the umbrella opened may also force the main runner slide downward as a result of lack of a limiting stop.

3. The collapsed umbrella can not be received in a compact manner due to the addition of the spring elements, the main frame and the stretching ribs can not closely abut against the central post, making the collapsed umbrella bulky in size.

SUMMARY OF THE INVENTION

The primary object of the present invention is to provide an umbrella opening and closing device without use of spring latches so as to make the structure of an umbrella simple and effectively reduce the assembly time in production.

Another object of the present invention is to provide an umbrella opening and closing device without use of spring latches which is provided with a first retainer extended from the upper mounting member of an umbrella with a number of female cavities disposed thereon that are integrally complementary in shape and size to the corresponding male protrusions on a second retainer integrally associated with the slidable main runner located on the central post of the umbrella whereby the expanded canopy of the umbrella can be supported in place when the first retainer and the second retainer are engaged with each other.

One further object of the present invention is to provide an umbrella opening and closing device which is provided with a rib securing ring located under the second retainer and having a plurality of equally spaced securing recesses disposed on the periphery thereof so as to firmly hold the stretching ribs in place as the umbrella is closed and received.

DETAILED DESCRIPTION OF THE PREFERRED EMBODIMENT

Figure 1:
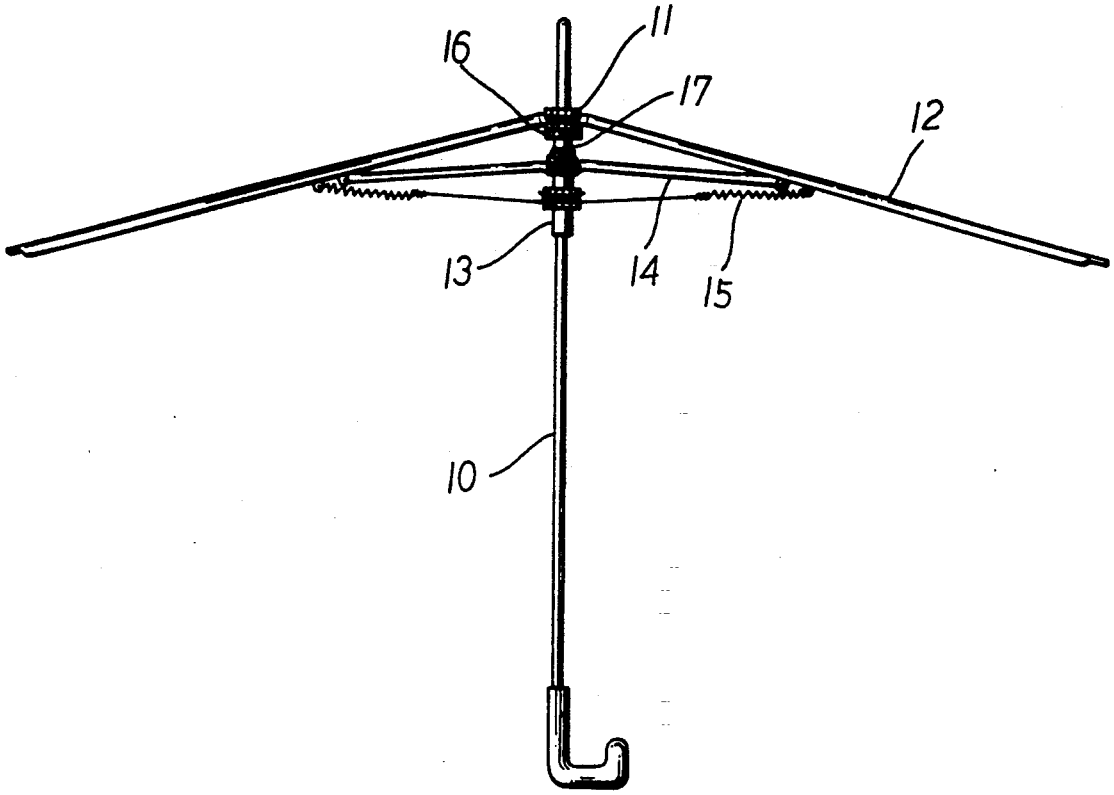
FIG.1 (PRIOR ART)
FIG. 1 is a diagram showing a prior art umbrella without the use of spring latches for opening and closing purpose.
Figure 2:
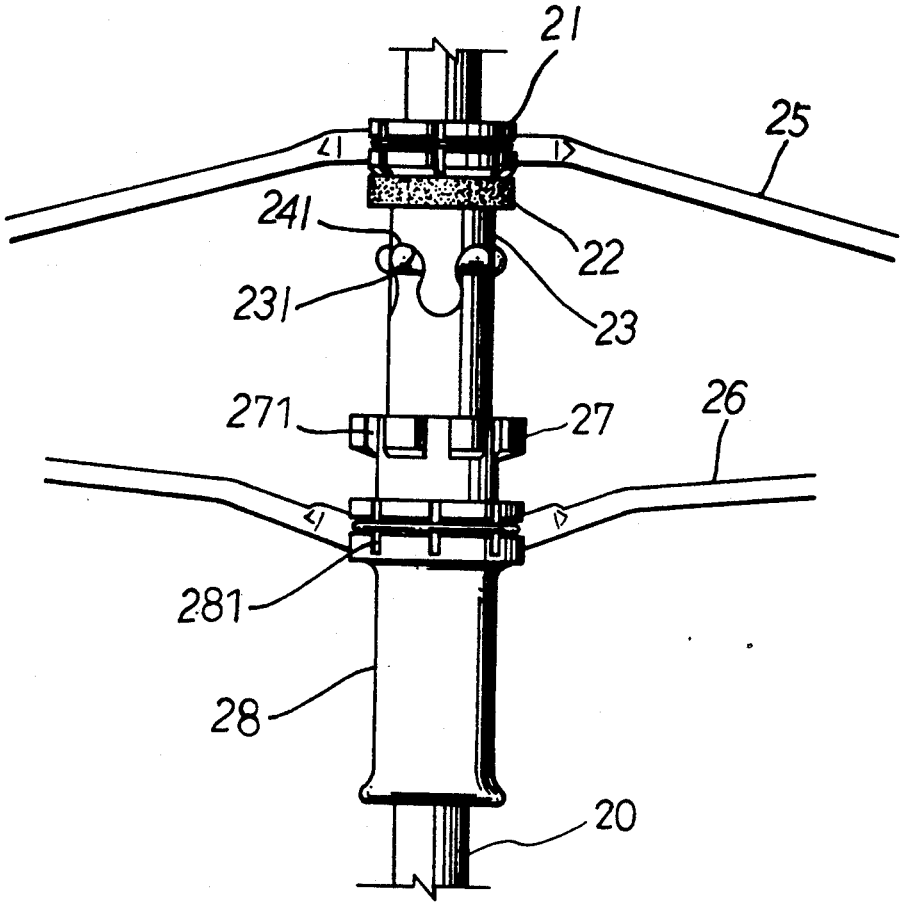
FIG. 2 is a plane view of the present invention.
Figure 4:
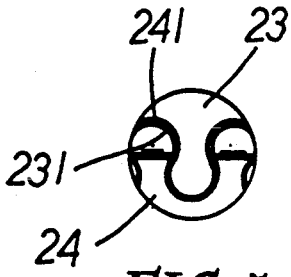
FIG. 4 is a diagram showing the complementary engagement of the first and second retainer thereof.

Referring to FIG. 2, the umbrella opening and closing device of the present invention is clearly shown; the top of a central post 20 is provided with an upper mounting member 21 to which are connected the canopy supporting ribs 25 of the main frame. Extended downardly from the upper mounting member 21 is a first retainer 23 having a number of Ω shaped female cavities 231 disposed on the periphery thereof. A shock absorbing member 22 is disposed right under the upper mounting member 21 and above the female cavities 231 of the first retainer 23. A slidable main runner 28 is secured to the central post 20 with a second retainer 24 having a number of Ω shaped male protrusions 241 disposed at the top end thereof that are complementary in shape to the female cavities 231 of the first retainer 23 so that the first retainer 23 and the second retainer 24 can be tightly engaged with each other, as shown in FIG. 4, when the main runner 28 is pushed upward against the first retainer 23 so as to keep the opened umbrella supported in place.

Figure 3:
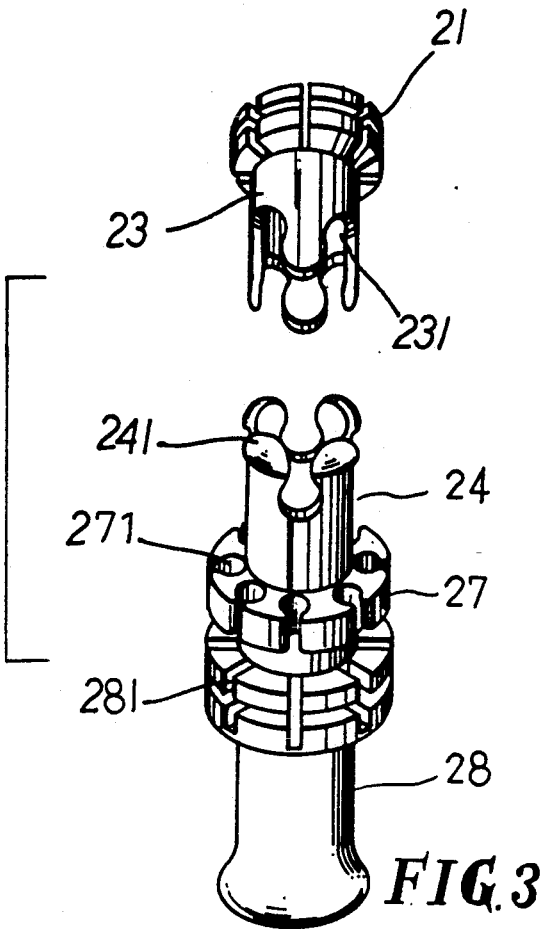
FIG. 3 shows perspectively exploded components thereof.
Figure 5:
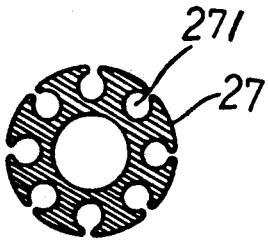
FIG. 5 is a sectional view of the rib securing ring.
Figure 6:
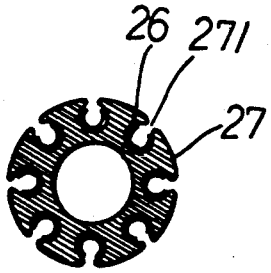
FIG. 6 is a sectional view showing the engagement of stretching ribs with the rib securing ring.
Figure 7:
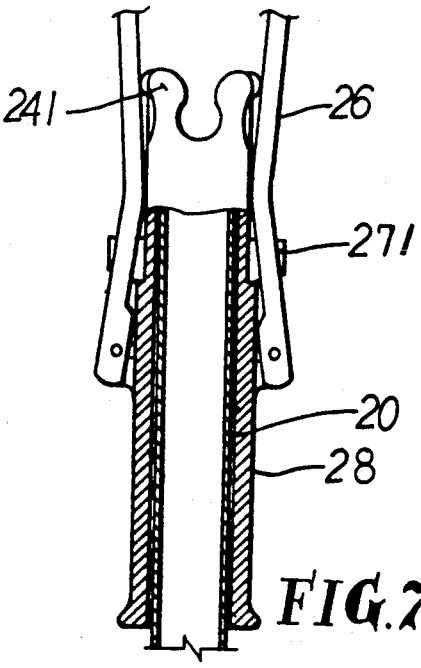
FIG. 7 is a sectional view showing the location of the stretching ribs in a well received umbrella thereof.

Below the second retainer 24 is disposed a rib securing ring 27 having a plurality of Ω shaped securing recesses 271 each disposed in linear alignment with a corresponding groove 281 disposed under the securing ring 27 in which one end of a stretching rib 26 is pivotally located, as shown in FIG. 3 so that the stretching ribs 26 can be tightly engaged with the shaped securing recesses respectively as the umbrella is closed, as shown in FIGS. 6, 7. Referring to FIG. 5, each securing recess 271 is flexibly expanded or contracted so as to permit the stretching ribs 26 to be easily engaged therewith.

It can be clearly seen that the first retainer 23 and the second retainer 24 can be tightly engaged with each other by way of the coupling of the complementary male protrusions 241 of the second retainer 24 and the female cavities 231 of the first retainer 23 so as to lock the main runner 28 in place when the umbrella is forced to open with the canopy thereof expanded. The collapsing or closing of the umbrella is effected in a reverse manner, making the first retainer 23 and the second retainer 24 disengaged with each other so as to permit the main runner 28 to slide downwardly. The stretching ribs 26 are forced to engage with the securing recesses 271 of the rib securing ring 27 so as to make the closed umbrella firmly and compactly received.

There are a number of apparent advantages associated with the present invention given as below:

1. The lack of spring latches and the extension spring elements makes the structure thereof simple and production easy and the cost reduced.

2. The stretching ribs can be in close abutment against the cetral post of the umbrella when the same is closed so as to make the umbrella compactly received.

3. The structure of the present invention permits the first retainer and the second retainer to be integrally produced along with the upper mounting member and the main runner without extra production procedure.

4. The umbrella of the present invention can be securedly opened and firmly and compactly received.

I claim:

1. An umbrella opening and closing device without use of spring latches comprising a first retainer and a second retainer and a rib securing ring having a plurality of spaced securing recesses defined on the periphery thereof; said first retainer being extended downwardly from an upper mounting member to which the main frame of an umbrella is pivotally attached and having a number of Ω shaped female cavities disposed thereon; said second retainer integrally extended from a main runner having a plurality of spaced grooves disposed thereon in which the stretching ribs of said umbrella are pivotally located; and said grooves being positioned in linear alignment with said securing recesses so that the stretching ribs can be firmly engaged with said securing recesses when said umbrella is closed for receiving; said second retainer being provided with a number of Ω shaped male protrusions disposed at the top end thereof which are integrally complementary in shape to said female cavities so as to permit the two to be tightly engaged with each other when said main runner is pushed upward along the central post of said umbrella so as to keep the canopy of said umbrella opened which is disposed on top of said main frame pivotally connected to said stretching ribs which are pivotally associated at another end with said main runner.

* * * * *